US005509635A

United States Patent [19]

Jaruzel

[11] Patent Number: 5,509,635

[45] Date of Patent: Apr. 23, 1996

[54] FORMWORK WITH FORM PANELS AND CONNECTING MEANS

[75] Inventor: Kurt Jaruzel, Haslach, Germany

[73] Assignee: Paschal-Werk G. Maier GmbH, Steinach, Germany

[21] Appl. No.: 269,872

[22] Filed: Jun. 30, 1994

[30] Foreign Application Priority Data

Jul. 5, 1993 [DE] Germany ..... 43 22 253.6

[51] Int. Cl.[6] ..... G04G 11/06

[52] U.S. Cl. ..... 249/47; 249/192; 249/196; 425/3

[58] Field of Search ..... 249/47, 192, 196; 425/3

[56] References Cited

U.S. PATENT DOCUMENTS

| | | | |
|---|---|---|---|
| 2,296,782 | 9/1942 | Fischer et al. | 249/192 |
| 3,246,871 | 4/1966 | Bowden | 249/189 |
| 3,584,827 | 6/1971 | Shoemaker | 249/45 |
| 4,151,975 | 5/1979 | Williams | 249/44 |
| 4,811,927 | 3/1989 | Slonimsky et al. | 249/210 |
| 5,160,640 | 11/1992 | Badstieber | 249/189 |

FOREIGN PATENT DOCUMENTS

| | | |
|---|---|---|
| 2442937 | 6/1980 | France . |
| 1534952 | 8/1969 | Germany . |
| 2403325 | 7/1975 | Germany . |
| 2137505 | 11/1980 | Germany . |
| 3122191 | 1/1983 | Germany . |
| 8502756 | 6/1986 | Germany . |
| 8622359 | 2/1988 | Germany . |
| 8814208 | 2/1989 | Germany . |
| 3838509 | 12/1989 | Germany . |
| 3838489 | 7/1991 | Germany . |

*Primary Examiner*—Timothy M. McMahon
*Assistant Examiner*—N. Bhat
*Attorney, Agent, or Firm*—Panitch Schwarze Jacobs & Nadel

[57] ABSTRACT

Formwork with form panels 1 and connecting means, namely clamps 7 and/or bolts 11 includes closed, hollow marginal sections 2 having an abutment web 5 projecting at right angles to a lining skin 4 and extending along the outermost edge of the form panel 1 and serving to be laid tightly against a corresponding abutment web 5 or flat marginal strip 13 of a neighboring form panel. Holding webs 6 of the marginal sections 2 may have depressions 8 for application of clamp points. Oblong perforations or keyholes 10 for inserting connecting bolts 11 are provided side by side, in spaced relationship, longitudinally of the abutment web. The connecting bolts have projections 12 that jut out radially from an end of the bolt and engage behind the edges of the perforations in a locking position. The spacing and size of the perforations 10 corresponds with similar perforations 10 in marginal sections 2 or flat marginal strips 13 of adjacent form panels 1. The clearance between the projections 12 and an axially spaced counter-stop 14 of the connecting bolt 11 is approximately equal to the overall thickness of adjacent abutment webs 5 and/or flat marginal strips 13, so that form panels having either flat marginal strips 13 and/or hollow marginal sections can be connected to each other with the aid of such connecting bolts 11.

18 Claims, 5 Drawing Sheets

3
31
4
7
9
6
2
22
25
26
8
24
27
17
5
19
20
23

FORMWORK WITH FORM PANELS AND CONNECTING MEANS

FIELD OF THE INVENTION

The invention relates to formwork, particularly for pouring concrete structures, with form panels and means of connecting the same, wherein marginal sections having a closed, hollow cross section are provided at parallel edges of form panels with an abutment web extending at right angles to the lining skin of the form panel and along the outermost edge of the form panel, serving to be laid tightly against a corresponding abutment web of a neighboring form panel. The marginal sections further have on a holding web approximately parallel thereto points of application for connecting clamps embracing the marginal sections of adjacent form panels. Perforations for inserting connecting bolts are provided longitudinally side by side, in spaced relationship, in the abutment webs of the hollow marginal sections.

BACKGROUND OF THE INVENTION

Such formwork is known from German Patent DE 38 38 488 C2. The marginal sections, provided with a closed, approximately rectangular hollow cross section, have in the holding web a channel-like depression for application of a clamp, as is known by way of example from German Utility Model No. 88 14 208. Such a clamp is made to conform to double the size of a hollow marginal section and can bring about only a frictional connection.

In many cases, however, it may be suitable for form panels of the formwork to have not only marginal sections with a hollow cross section, but also marginal strips consisting of flat material, this being advantageous particularly if and when, for instance, form panels variable in their curvature are to be combined with flat form panels. The clamps permitting a specific closing travel are unsuited for such combinations of a hollow marginal section with a marginal strip consisting of flat material.

Hitherto, such form panels with only flat marginal strips have been connected, as a rule, by connecting bolts conforming generally to German Patent No. 21 37 505. However the clearance between projections jutting out at right angles to the bolt surface and counter-stops is too small for these connecting bolts to be able to traverse marginal sections having a hollow cross section.

A proposal has become known from German Patent DE 38 38 509 C1 that two marginal sections having a hollow cross section be traversed in a direction parallel to the lining skin and thereby be connected by a relatively long and elaborate bolt. However, this requires that the hollow sections have through holes which either weaken them or have to be furnished with sleeves inside the marginal sections as a guide for the respective bolt, increasing the manufacturing expenditure accordingly.

SUMMARY OF THE INVENTION

The object underlying the invention is to provide formwork of the kind mentioned at the outset, enabling form panels having hollow marginal sections to be connected in any manner to one another or also to form panels the marginal strips of which consist of flat material. The latter hence do not have a hollow cross section and do not have multiple bends, but lie practically only in,the peripheral plane oriented at right angles to the facing skin. Their free edge also terminates in this peripheral plane.

This object is accomplished in that abutment webs are provided with keyhole-like or oblong perforations therein for connecting bolts having at the end thereof at least one projection jutting out radially from the cross section of the bolt in the connected position. The projection is insertable with the connecting bolt through the keyhole or oblong perforation and engages behind the edge of the perforation in the locking position or twisted position. The spacing and size of the perforations in the abutment web accords with the corresponding dimensions of such perforations in flat marginal strips of further form panels, and the clearance between the projection jutting out radially and an axially spaced counter-stop of the connecting bolt corresponds to the overall thickness of a marginal web composed of a flat material and the thickness of the abutment web of a hollow section.

This arrangement and solution enables, in a surprising fashion, a flat marginal strip of a form panel featuring only such strips to be fastened to a hollow marginal section with the aid of a connecting bolt which is inserted in the registering perforations and is secured by twisting or in another way. A perforation passing through the entire hollow section is avoided in the same way as a special clamp which would have to be reduced to half the size of its usual clamping width. Nevertheless, it is naturally also possible within a formwork system for such form panels as have marginal sections presenting a hollow cross section to be fitted together by connecting them with a clamp.

Furthermore, form panels having only flat marginal strips can likewise be connected to one another with the aid of the outlined connecting bolts conforming generally with German Patent No. 21 37 505. Hence, a wide spectrum of possibilities for combination within the overall formwork ensues, so that a user can combine such different form panels, depending on what loading cases arise.

In an advantageous way the holding web, that belongs to the hollow marginal section and is situated opposite the abutment web and likewise runs approximately at right angles to the lining skin, may be unperforated. The connecting bolt is required if a flat marginal strip is to be fastened to a marginal section having a hollow cross section. The connecting bolt can them be passed with its projection from the marginal strip into the interior of the hollow cross section of the marginal section and can then be twisted to locate it in position, so that the laterally protruding projection(s) of this connecting bolt interiorly lap over the edges of the perforation in the marginal section. It is avoided that the connecting bolt be passed through the entire marginal section, allowing the connecting bolt to be correspondingly short and practically of such a type as was hitherto provided for connecting two form panels having only flat marginal strips.

While the projection provided on the connecting bolt suitably juts out on both sides radially from this bolt end and, for instance, may take the form of a cross pin or be integral. The counter-stop of the connecting bolt may be a disc spring and/or a clamping nut. A disc spring intensifies the desired pressing together of the formwork members to be connected.

In order that a clamp can also be well applied to the hollow marginal section, the hollow cross section of the marginal section may be approximately rectangular or square, and the holding web averted from the abutment web may be formed with a least one corrugation, channel, groove or depression for the application of corresponding projections of a fastening clamp. The marginal section hence has a shape permitting a clamp to be applied, but also affording the possibility of applying a connecting bolt if the edge running around a form panel to be fastened thereto has a different configuration, namely only a flat marginal strip.

The hollow section may be closed at the back of the lining skin by a fastening web that bears against the lining skin and runs at approximately right angles to the abutment web. The lining skin, particularly one of wood, may bear against this fastening web. The lining skin can hence extend almost to the outermost edge of the form panel and in any case further than given by the holding web of the marginal section.

An expedient development of the invention, for optimal transfer of the forces arising through connection to a neighboring form panel with flat marginal strips, contemplates that the abutment web provided with perforations is thicker than the other webs of the hollow marginal section, and that the other webs of the marginal section are formed by an approximately U-shaped section that bears with its edges against the abutment section and is welded thereto at at least one edge. By virtue of a thicker abutment web, the forces transferred through connecting bolts can hence be introduced without the danger of deformation.

At the same time, in a manner favorable for the overall weight of the form panel, the remaining part of the hollow marginal section can have a wall cross section that is thinner but, on account of the hollow cross section, nevertheless suffices to be able to sustain the forces transferred by a clamp. In a surprising way, the hollow marginal section having different edge thicknesses is hence adapted to the respective connecting means and forces transferred, thereby in such a manner that any of the connecting means to be used, whether it be a clamp or connecting bolt, can transfer the corresponding forces without any danger of unwanted deformations.

Further developments of the hollow marginal sections and the arrangement of the perforations as well as the fastening of the lining skin are described briefly in the following. It may be sufficient to form the hollow section by welding the U-section to the abutment web only at one edge, namely at the edge remotest from the lining skin. The other U-limb in the form of a fastening web may be movable relative to the abutment web. This is advantageous for the mode of fastening the lining skin using tapped holes, because a screwed/bolted connection is effected with this fastening web, and its welding to the abutment web might lead to unwanted deformations or distortions and would not allow any adaptation to the path of the lining skin.

Thus, the lining skin can have its edge bordered within a groove formed in the marginal section, hence having a good fixation which may be improved further by having screws/bolts traverse the lining skin. The lining skin can be clamped with the aid of these screws/bolts, because the fastening web can be drawn and pressed against the lining skin by tightening the screws/bolts, without hindrance by being fastened or welded to the abutment web.

The corrugated-like depression for application of the fastening clamp may suitably be arranged near the junction of the holding web and the fastening web, thus providing additional stiffening at this location.

The perforations for inserting connecting bolts may be arranged as close as possible to the lining skin, without the projections jutting out radially from such connecting bolts being obstructed by the fastening web.

Finally, the form panels of the formwork may be provided with marginal sections in which the U-shaped part has breaks and anchoring points, so that the panels are adjustable with respect to their curvature by draw spindles or turnbuckles applied to stiffening girders and marginal sections connected to the lining skin.

Particularly if the features and measures described above are combined singly or severally, connecting means of entirely different types can be used and combined for joining form panels. On the one hand, the known connecting bolts can be used, enabling two form panels to be connected at the same level, firmly and absolutely securely, not only frictionally but also form-lockingly through the bolts themselves. That is, by means of such connecting bolts, the form panels can be connected also by the shearing forces to be taken up by the bolts and not only through frictional forces. On the other hand, however, connecting clamps may also be used. This is particularly advantageous if neighboring segments or form panels are at different levels and is suitable if and when two form panels or segments having marginal sections presenting a hollow cross section butt each other.

In any event, form panels having marginal sections presenting a closed, hollow cross section are entirely compatible with form panels having only flat marginal strips. All in all, shorter erecting time can also be achieved. Finally, the combination of form panels with marginal sections on the one hand and marginal strips on the other hand allows more versatile adaptation to different curvatures, particularly if the radius of curvature is small.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings, partly in schematic form.

DETAILED DESCRIPTION OF PREFERRED EMBODIMENTS

Figure 1:
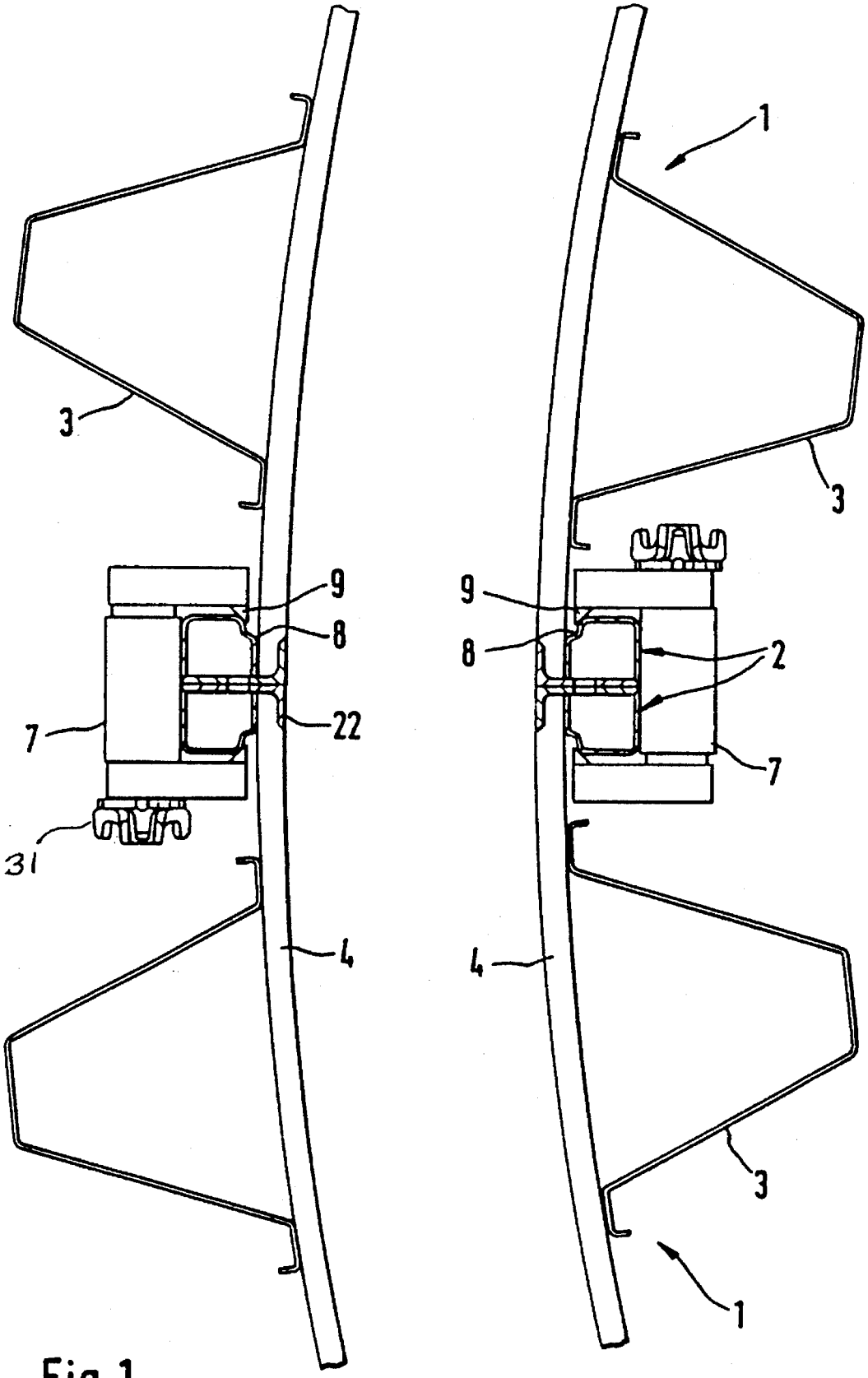
FIG. 1 shows a top view of formwork according to the invention, wherein mutually opposed form panels are curved in the same direction and have at their contiguous edges marginal sections which present a closed, hollow cross section and are embraced by clamps for their connection.

Formwork, shown in part in a top view of FIG. 1 comprises adjoining form panels 1. In the present exemplified embodiment marginal sections 2 are provided at their edges and present a closed, hollow cross section, and trapezoidal stiffening girders 3 are provided therebetween. The form panels are suited for forming curved surfaces and may even be changed in their curvature. The lining skins 4 of the form panels may suitably be made of wood, preferably a wood laminate, while the marginal sections 2 and trapezoidal stiffening girders 3 may suitably be made of metal, preferably iron. Those skilled in the art will recognize that other construction materials may also be suitable in given circumstances.

Figure 2:
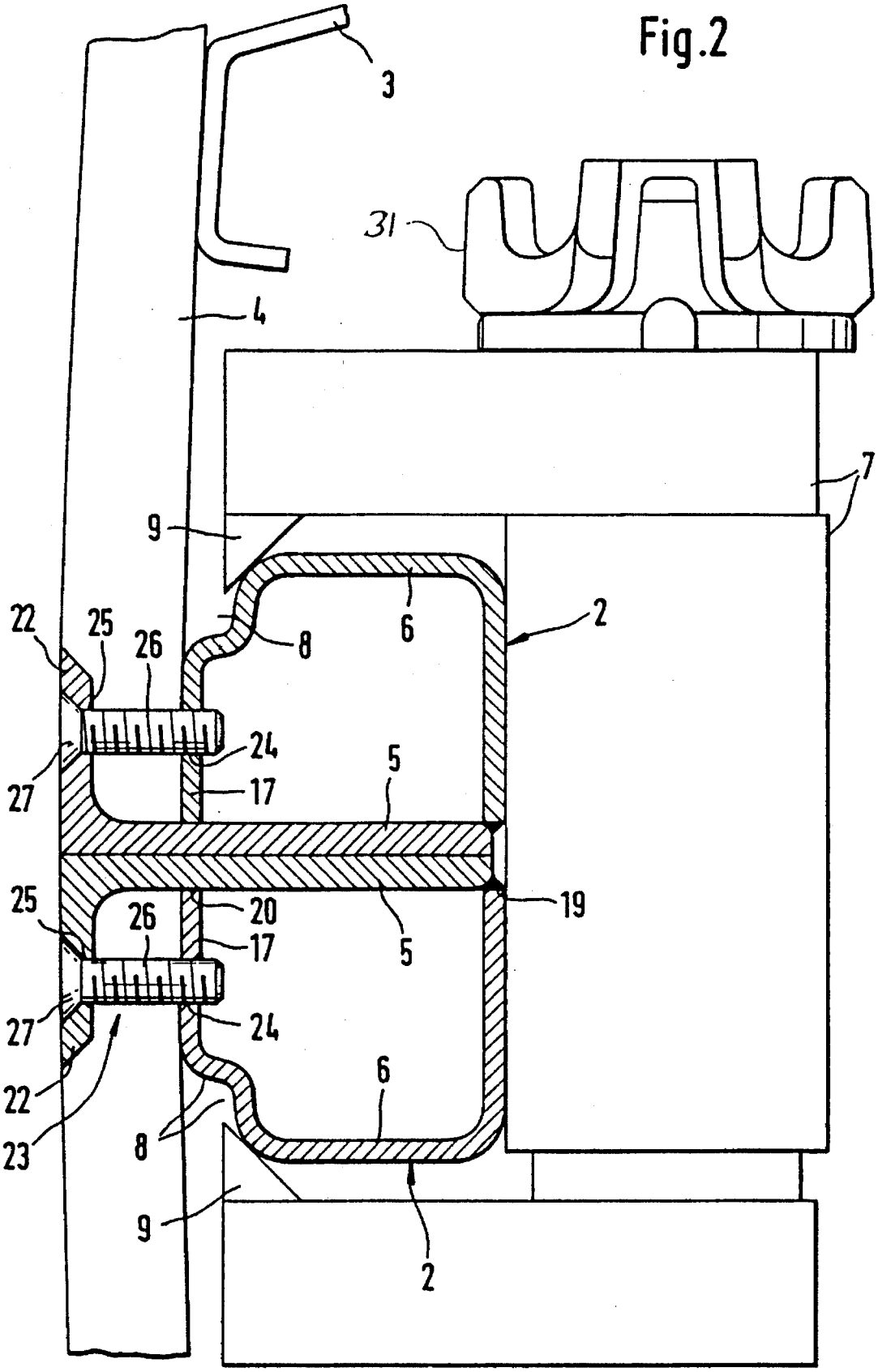
FIG. 2 shows, on an enlarged scale, the connection of two form panels of the invention having at their edges marginal sections presenting a closed, hollow cross section, wherein a clamp embracing both marginal sections serves for connection.
Figure 3:
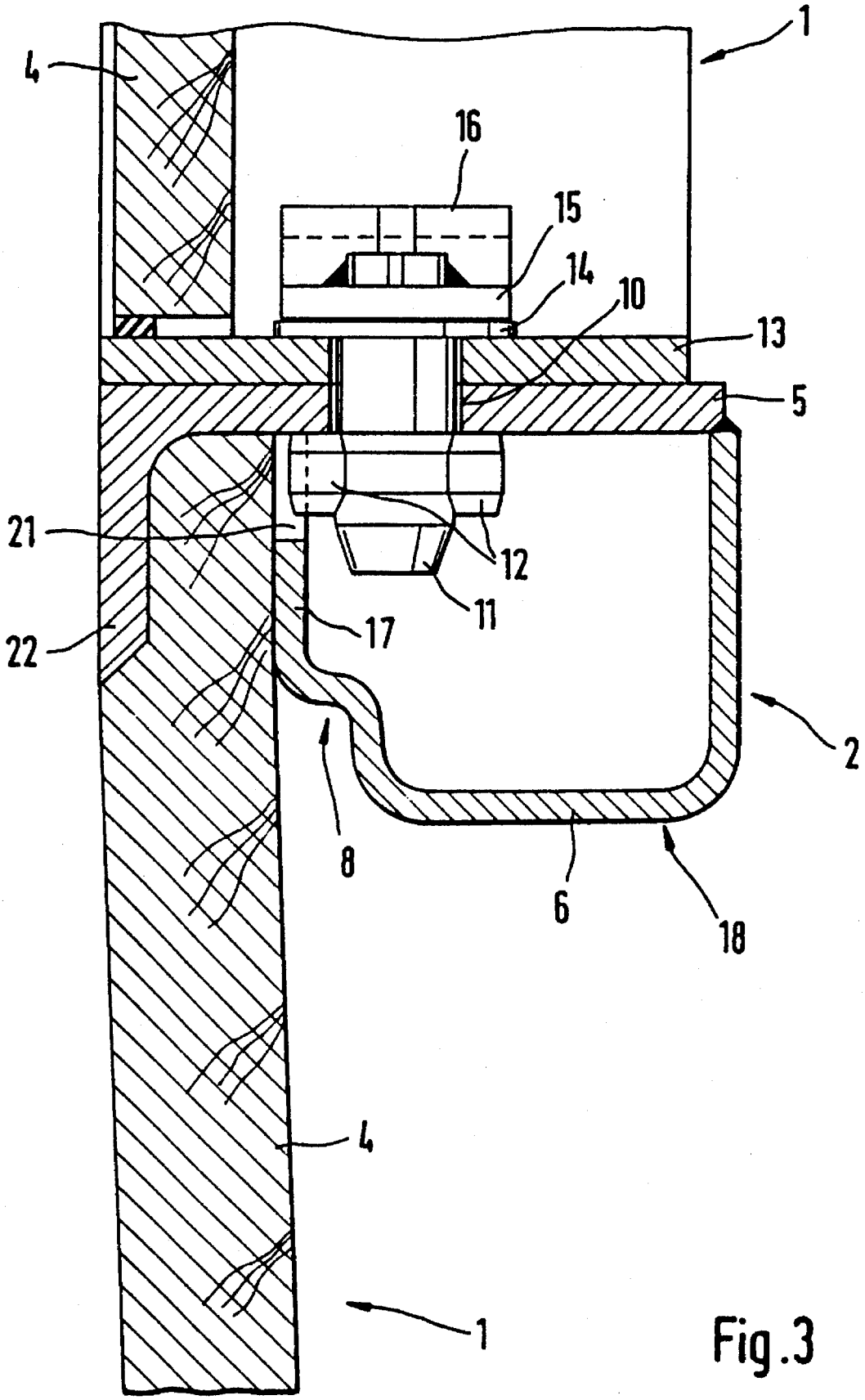
FIG. 3 shows a connection according to the invention between a form panel having a hollow section arranged at its edge and a form panel having only a flat stiffening strip at its edge, where a connecting bolt serves for connection, the connecting bolt having in one end zone two projections jutting out radially and in the other end zone a counter-stop.
Figure 4:
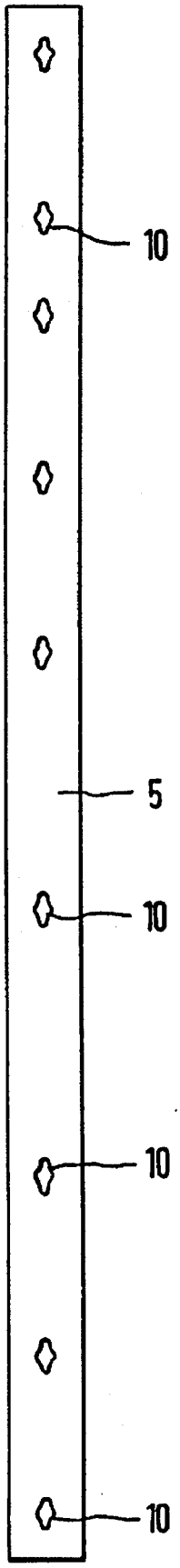
FIG. 4 illustrates a face view of an abutment web of a marginal section having a hollow cross section or of a flat stiffening strip, wherein approximately keyhole-like perforations for connecting bolts are provided in spaced relationship to one another.
Figure 6:
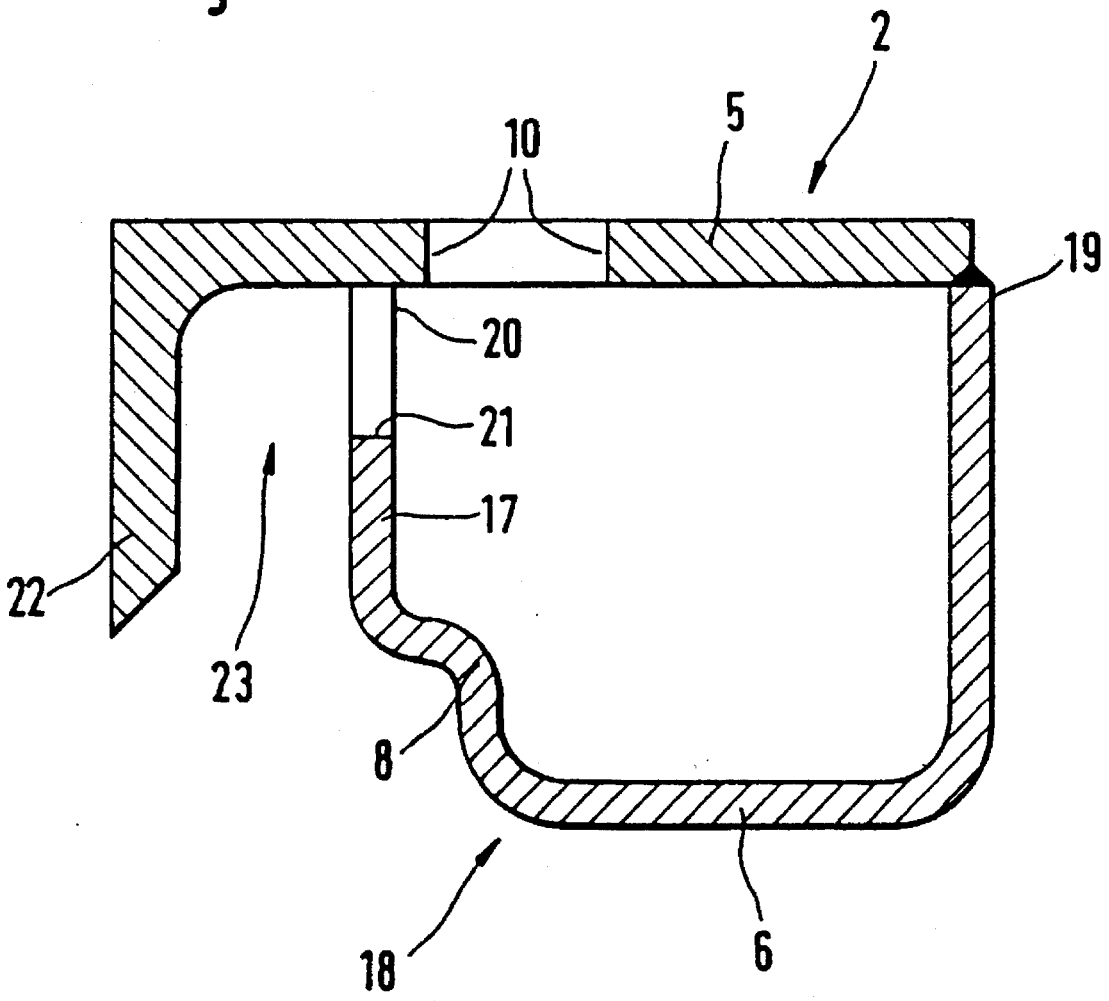
FIG. 6 is a cross sectional view through the marginal section having a hollow cross section, in the area of a perforation for a connecting bolt, the cross-section being taken along line VI—VI in FIG. 5.

It is to be seen particularly in FIGS. 2, 3 and 6 that such a marginal section 2 has in each case located at right angles to the lining skin 4 an abutment web 5 extending at the outermost edge of the form panel 1 and serving to be laid tightly against a corresponding abutment web 5 of a neighboring form panel (FIGS. 1 and 2). The marginal section further has located on a holding web 6 approximately parallel thereto points of application for connecting clamp 7 embracing the marginal sections 2 of adjacent form panels 1.

The hollow cross section of the marginal section 2 is approximately rectangular or square, and the holding web 6 averted from the abutment web 5 is formed with a depression 8 for the application of corresponding projections 9 of the respective fastening clamp 7. The fastening clamp 7 is tightened by a wing nut 31 which turns a longitudinal bolt (not shown).

According to FIGS. 3 to 6, perforations 10 for inserting one connecting bolt 11 in each case are provided side by side, in spaced relationship—possibly at varying spacing—along the longitudinal direction of the abutment webs 5 of the hollow marginal sections 2. According to FIG. 4 the perforations may be keyhole-like, and according to FIG. 5 they may alternatively be oblong. According to FIG. 3, the connecting bolt 11 has projections 12 of the same length, jutting out at the end from its cross section on both sides. The bolt 11 is adapted to be inserted with these projections 12 through the perforation 10 in question and then to be positioned by twisting. In the locking position illustrated in FIG. 3, the projections 12 engage behind the edges of the perforation 10 after connecting bolt 11 has been twisted accordingly. The bolt can be twisted in the opposite direction through about 90° for release, so that the projections 12 can then be drawn through the longer expanse of the perforation 10.

The spacing and size of the perforations 10 in the abutment web 5 accords with the dimensions of such perforations 10 in marginal strips 13 made of flat material, forming part of adjoining form panel 1. Therefore, according to FIG. 3, form panels with different edges can be fastened together with the aid of such a connecting bolt, whereby the lining skin 4 thereof is aligned as wanted on the side facing the concrete. Hence, form panels 1 with different marginal sections 2 and/or marginal strips 13 can be combined.

It is important that the clearance between the radially jutting out projections 12 and a spaced counter-stop 14 of the connecting bolt 11 corresponds to the overall thickness of a flat marginal strip 13 and the thickness of the abutment web 5 of the hollow section 2, as is apparent in the light of FIG. 3. In the present instance the counter-stop 14 is formed by a disc spring bearing against a head 15 of the connecting bolt 11, which head may also carry a handle 16 for twisting this connecting bolt 11.

It becomes clear in the light of FIG. 3 and also the other Figures that the holding web 6, which belongs to the hollow marginal section 2, is opposite the abutment web 5 and likewise runs at right angles to the lining skin 4, is not perforated and hence is not weakened. In point of fact, the depression 8 is located approximately in extension of the perforation 10, so that a perforation for a connecting bolt 11 reaching through the thickness of the entire hollow section 2 would be very unsuitable at this location.

According to FIGS. 1 to 3, the hollow marginal section 2 is closed at the back of the lining skin 4, i.e., facing away from the concrete, by a fastening web 17 that bears against this lining skin 4 and runs at approximately right angles to the abutment web 5. The lining skin 4, particularly one of wood, can bear against this fastening web 17 and even be anchored in an advantageous fashion according to the description below.

To begin with, it is pointed out that in all the exemplified embodiments the abutment web 5 provided with perforations 10 is thicker than the other webs of the hollow marginal section 2, hence the hollow marginal section 2 has a greater wall thickness in the area of the abutment web 5 than in the rest of its cross section. This is appropriate because, when using a connecting bolt 11 according to FIG. 3, the resultant forces are to be absorbed in the area of the abutment web 5. On the other hand, when using a connecting clamp 7, the closed hollow cross section, even if of thinner wall thickness, is sufficiently stiff in itself to be able to transfer the forces then arising.

These different wall thicknesses of the cross section of the marginal section 2 are achieved in that the other webs of the marginal section 2 are composed of an approximately U-shaped section 18 (cf. FIG. 6) having its U-limbs limbs and edges thereof 19 and 20 bearing against the abutment section 5 on the rear side thereof, averted from the butting side, and being welded to the abutment section at at least one edge, in the exemplified embodiment edge 19. In a simple way the abutment section 5 could hence be a standard rolled section, e.g. an angle section, to which a U-shaped further section 18 is connected in the manner outlined.

Therefore, despite the use of different wall thicknesses, this marginal section 2, which is to have perforations 10 in the abutment web 5, involves relatively little expenditure to produce, because the perforations 10 can be made easily before the connection to the U-section 18. In a manner to be described further below, it is advantageous in this connection that the U-section 18 composing or closing the hollow cross section of the marginal section 2 is welded to that edge of the abutment web 5 which is remotest from the lining skin 4.

In the exemplified embodiment the corrugated-like depression 8 for the fastening clamp 7 is provided at the location where the holding web 6, situated at right angles to the lining skin, merges into the fastening web 17 bearing against the lining skin 4, as is apparent in FIGS. 1 to 3 and 6. The forces of the connecting clamp 7 can hence be transferred to the marginal sections 2 as closely as possible to the lining skin 4, resulting in minimal bending stresses on these marginal sections 2 and, above all, on the abutment webs 5.

The perforations 10 in the abutment web 5 are also arranged within the marginal section 2 as closely as possible to the lining skin 4 in order to bring about optimal transfer of force. It follows from FIG. 3 that the perforations 10 are arranged so close to the lining skin 4 that in the anchoring position the respective projection 12 jutting out radially from the connecting bolt 11 and pointing in the direction of the lining skin 4 extends interiorly up to the fastening web 17 bearing against the lining skin 4. According to FIG. 3 the projection 12 may even engage with a recess 21 provided in the fastening web 17 near the perforations 10 in the abutment web 5.

This permits not only an arrangement of the connecting bolt 11 as close as possible to the lining skin 4, but also a combination of a from panel 1 having a flat marginal strip and possibly a thinner lining skin 4 than the other form panel 1 with a hollow marginal section 2, as FIG. 3 shows. Despite the thicker lining skin 4 in the area of the hollow marginal section 2, the perforations 10 can be arranged at a conforming distance from the edge or plane of the lining skin 4 facing the concrete, so that the two form panels are in alignment on their side facing the concrete in the manner illustrated in FIG. 3.

The abutment web 5 has, in the exemplified embodiment at its edge averted from the hollow section and facing the concrete, a flange 22 that engages behind the side of the lining skin 4 facing the concrete and is sunk into the lining skin 4. Together with the fastening web 17, the flange 22 forms a groove 23 for embracing the edge of the lining skin 4, as is evident in FIG. 6. Hence the lining skin 4 is in this case bordered in a frame-like manner at its outermost edge, enabling a very good and firm connection to the hollow marginal section 2 to be established. The flange 22 may be a limb of an angle section composing the abutment web 5.

It follows particularly from FIG. 2 that the fastening web 17, that forms part of the hollow marginal section 2 and bears against, the side of the lining skin 4 averted from the concrete, has threaded or tapped holes 24 arranged in spaced relationship to one another, and the fastening flange 22 lapping over the side of the lining skin 4 facing the concrete has, at registering height, holes 25 for inserting fastening screws/bolts 26 traversing the lining skin in this edge area. One sees that the heads 27 of the fastening screws/bolts 26 are sunk into the respective flange 22 and, when the screws/bolts 26 are tightened, the fastening web 17 is hence drawn from the other side towards the lining skin 4, so that the latter can be clamped firmly in the groove 23.

It is important in this connection that the fastening web 17, that forms part of the marginal section 2 and presents the tapped holes 24, and suitably also the lining skin 4 extend to the outside of the abutment web 5 and that the fastening web 17 is movable relative to the abutment web 5 on account of elastic bending. At this point it becomes clear why it is suitable to leave the edge 20 of the U-section 18 unfastened to the abutment web 5. The thus constituted elastic movability of the fastening web 17 allows it to perform the necessary clamping movement relative to the lining skin 4 as the screws/bolts 26 are tightened, especially since the flange 22 is thicker than the fastening web 17.

In comparing FIGS. 2 and 6 it is apparent that the tapped holes 24 are staggered in the longitudinal direction of the marginal section 2 relative to recesses 21 for retaining projections 12 of fastening bolts 11. It is thus avoided that the fastening screws/bolts 26 and Connecting bolts 11 might collide. In addition, the tapped holes 24 can be arranged at a most convenient location of the fastening web 17 unaffected by the recesses 21.

Figure 5:
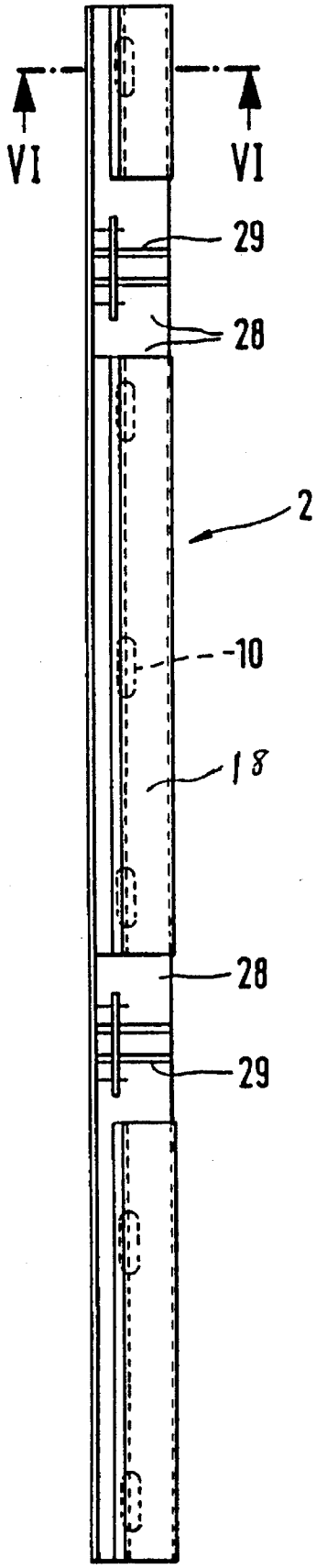
FIG. 5 is a side view of a marginal section from the side averted from the abutment web.

FIG. 5 indicates that the U-shaped part 18 of the marginal section 2 is provided with breaks 28 and anchoring points 29 in the form of sleeves and flanges of draw spindles or turnbuckles for rendering the form panels adjustable in their curvature according to FIG. 1. The perforations 10, in this case oblong perforations, in the abutment webs 5 are staggered in the longitudinal direction of the marginal section 2 relative to these anchoring points 29.

Particularly in comparing FIGS. 2 and 3, one sees that the formwork permits the interconnection of form panels 1 having differently designed edges and accordingly different connecting means may then be used. The form panels 1 having hollow marginal sections 2 are fully compatible with form panels 1 having flat marginal strips 13. If form panels 1 both having hollow marginal webs are interconnected, the known connecting clamp 7 can be used, while form panels 1 having only flat marginal strips 13 can also be connected with the aid of connecting bolts 10 by virtue of the perforations 10 in the abutment webs 5 of the hollow marginal sections 2. The entire formwork thereby becomes significantly more adaptable to different formwork problems, possibly also allowing narrower curvatures in areas and enabling an owner of form panels with flat marginal strips 13 to combine them with ones having hollow marginal webs 2. To do so, he can use the connecting bolts he already has, because the thickness of the abutment webs 5 is suitably the same as the thickness of the flat marginal strips 13 of these form panels.

In summary, the formwork with form panels 1 and means of connecting the same, namely connecting clamps 7 and/or connecting bolts 11, comprises form panels 1 having marginal sections 2 that present a closed, hollow cross section and in each case having projecting at right angles to the lining skin 4 an abutment web 5 that extends along the outermost edge of the form panel 1 and serves to be laid tightly against a corresponding abutment web 5 of a neighboring form panel, said marginal sections further having on a holding web 6, approximately parallel thereto, points of application in the form of depressions 8 for connecting clamps 7 embracing the marginal sections 2 of adjacent form panels 1.

Furthermore, perforations 10 for inserting connecting bolts 11 are provided side by side, in spaced relationship, along the longitudinal direction of the abutment webs 5 of the hollow marginal section 2. In an end zone the connecting bolts have projections 12 that jut out radially from the cross section of the bolts and engage behind the edges of the perforations in the anchoring or locking position, whereas in a twisted position it is possible for the bolt 11 with its projections 12 to be inserted and withdrawn, since the perforations 10 are oblong or keyhole-like ones. The spacing and size of the perforations 10 accords with the corresponding dimensions of such perforations 10 in marginal strips 13 made of flat material, forming part of further form panels 1.

The clearance between the projections 12 and an axially spaced counter-stop 14 of the connecting bolt 11 is approximately equal to the overall thickness of two flat marginal strips 13 or the overall thickness of a flat marginal 13 and an abutment web 5 of the marginal sections 2, so that form panels having flat marginal strips 13 can be connected to form panels having hollow marginal sections 2 with the aid of such connecting bolts 11. Furthermore, form panels having flat marginal strips 13 can be interconnected with the aid of the connecting bolts 11, and equally form panels having hollow marginal sections 2 can be interconnected by means of connecting clamps 7.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. Formwork particularly for pouring concrete structures with form panels (1) and means for connecting the panels, comprising marginal sections (2) having a closed, hollow cross section provided along parallel edges of and located at right angles to a lining skin (4) of form panels (1), said marginal section comprising an abutment web (5) that extends longitudinally along an outermost edge of the form panel (1) and serves to be laid tightly against a corresponding abutment web of a neighboring form panel, said marginal section further having a holding web (6) approximately parallel to the abutment web, said holding web having points of applications adapted for the attachment of connecting clamps (7) which embrace the marginal sections (2) Of adjacent form panels (1), said abutment web (5) having perforations (10) therein for inserting connecting bolts (11), the perforations (10) being arranged side by side, in spaced relationship along the longitudinal direction of the abutment web (5), each perforation (10) being oblong in shape for receiving a connecting bolt (11) having at least one projection (12) jutting out radially from an end of the bolt, the projection being insertable with the connecting bolt (11) through the oblong perforation (10) and engaging behind an edge of the perforation (10) in a locking position when twisted in the perforation, the perforations (10) in the abutment web (5) having a spacing and size which corresponds with dimensions of similar perforations in flat marginal strips (13) of neighboring form panels (1), the bolt (11) having a counter-stop (14) spaced axially from the projection (12), said axial spacing corresponding to an overall thickness of marginal strip (13) plus abutment web (5).

2. Formwork according to claim 1, wherein said oblong perforation (10) has a keyhole shape.

3. Formwork according to claim 1, wherein the holding web (6) is situated opposite the abutment web (5) and likewise runs approximately at right angles to the lining skin (4), said holding web being unperforated.

4. Formwork according to claim 1, wherein the counter-stop (14) of connecting bolt (11) is a disc spring.

5. Formwork according to claim 1, wherein the counter-stop (14) of connecting bolt (11) is a clamping nut.

6. Formwork according to claim 1, wherein the hollow cross section of the marginal section (2) is approximately rectangular, and the points of application in the holding web (6) comprise at least one corrugated-like depression (8) averted from the abutment web (5) for the application of corresponding projections (9) of a connecting clamp (7).

7. Formwork according to claim 6, wherein the corrugated-like depression (8) for the connecting clamp (7) is provided at the location where the holding web (6), situated at right angles to the lining skin (4), merges with a fastening web (17) forming part of the marginal section (2) and bearing against the lining skin (4).

8. Formwork according to claim 1, wherein the hollow marginal section (2) is closed adjacent the lining skin (4) by a fastening web (17) that bears against said lining skin (4) and runs at approximately right angles to the abutment web (5).

9. Formwork according to claim 8, wherein the abutment web (5) has, at an edge thereof averted from the hollow section and facing the concrete, a fastening flange (22) that engages behind a side of the lining skin (4) facing the concrete and is sunk into the lining skin (4), said flange together with the fastening web (17) forming a groove (23) embracing an edge of the lining skin (4).

10. Formwork according to claim 1, wherein said lining skin (4) comprises a wood laminate.

11. Formwork according to claim 1, wherein the abutment web (5) provided with perforations (10) is thicker than other webs of the hollow marginal section (2) and the other webs of the marginal section (2) comprise an approximately U-shaped section (18) having end edges (19, 20) bearing against the abutment web (5) and being welded to the latter at at least one edge (19).

12. Formwork according to claim 11, wherein the U-section (18) is welded to an edge of the abutment web (5) which is remotest from the lining skin (4).

13. Formwork according to claim 11, wherein the U-shaped part (18) is provided with breaks (28) and anchoring points (29) for draw spindles or turnbuckles for rendering the form panel (1) adjustable in its curvature, and the perforations (10) in the abutment web (5) are staggered in the longitudinal direction of the marginal section (2) relative to said anchoring points (29).

14. Formwork according to claim 1, wherein the perforations (10) in the abutment web (5) are arranged within the marginal section (2) so close to the lining skin (4) that in the locking position the projection (12) jutting out radially from the connecting bolt (11) extends to a fastening web (17) bearing against the lining skin (4).

15. Formwork according to claim 14, wherein the projection (12) engages with a recess (21) provided in the fastening web (17) near a perforation (10) in the abutment web (5).

16. Formwork according to claim 9, wherein the fastening web (17) has tapped holes (24) arranged in spaced relationship to one another and the fastening flange (22) has at registering height holes (25) for inserting fastening screws/bolts (26) through the lining skin (4).

17. Formwork according to claim 16, wherein the fastening web (17) extends to the abutment web (5) and is movable relative to said abutment web (5).

18. Formwork according to claim 16, wherein the tapped holes (24) are staggered in the longitudinal direction of the marginal section (2) relative to recesses (21) provided in the fastening web (17) for receiving projections (12) of fastening bolts (11).

* * * * *